US008152660B1

(12) United States Patent
Jimenez, Jr. et al.

(10) Patent No.: US 8,152,660 B1
(45) Date of Patent: Apr. 10, 2012

(54) BASKETBALL TRAINING DEVICE

(76) Inventors: David Jimenez, Jr., Atlantic City, NJ (US); James E Terrell, Pleasantville, NJ (US)

( * ) Notice: Subject to any disclaimer, the term of this patent is extended or adjusted under 35 U.S.C. 154(b) by 0 days.

(21) Appl. No.: 12/790,016

(22) Filed: May 28, 2010

Related U.S. Application Data

(60) Provisional application No. 61/217,074, filed on May 28, 2009.

(51) Int. Cl.
*A63B 69/00* (2006.01)

(52) U.S. Cl. ..... 473/450; 473/422; 473/447

(58) Field of Classification Search ..... 473/450, 473/458, 464, 422, 433, 434, 447
See application file for complete search history.

(56) References Cited

U.S. PATENT DOCUMENTS

| | | | | | |
|---|---|---|---|---|---|
| 3,552,749 | A | * | 1/1971 | Piggotte | 473/448 |
| 3,675,921 | A | * | 7/1972 | Meyers, Sr. | 473/448 |
| 3,820,783 | A | * | 6/1974 | Caveness | 473/450 |
| 3,868,108 | A | * | 2/1975 | Kirchner | 473/450 |
| D265,493 | S | * | 7/1982 | Kringlie | D21/701 |
| 4,383,685 | A | * | 5/1983 | Bishop | 473/450 |
| 4,579,341 | A | * | 4/1986 | Furr | 473/450 |
| 4,989,862 | A | * | 2/1991 | Curtis | 473/448 |
| D321,370 | S | * | 11/1991 | Curtis | D19/62 |
| 5,320,342 | A | * | 6/1994 | Houck | 473/450 |
| 5,413,328 | A | * | 5/1995 | Glancey et al. | 473/439 |
| 5,485,993 | A | * | 1/1996 | Lipsett | 473/448 |
| D370,242 | S | * | 5/1996 | Bright | D21/781 |
| 5,527,185 | A | * | 6/1996 | Davis | 473/438 |
| 5,816,951 | A | * | 10/1998 | Hudock | 473/447 |
| 5,890,985 | A | * | 4/1999 | Jenney | 473/447 |
| 6,203,453 | B1 | * | 3/2001 | Coddens | 473/450 |
| 6,461,256 | B1 | * | 10/2002 | Popeck | 473/450 |
| 6,622,309 | B1 | * | 9/2003 | Edmonds | 2/9 |
| 6,645,093 | B2 | * | 11/2003 | Sheppard | 473/450 |
| 6,712,722 | B1 | * | 3/2004 | Mosley | 473/450 |
| 6,866,595 | B1 | * | 3/2005 | Elder et al. | 473/446 |
| D539,373 | S | * | 3/2007 | Cook | D21/781 |
| 7,618,334 | B2 | * | 11/2009 | Bridge et al. | 473/422 |
| 7,658,689 | B2 | * | 2/2010 | Crook, II | 473/447 |
| 2003/0211906 | A1 | * | 11/2003 | Seltzer et al. | 473/450 |
| 2006/0199676 | A1 | * | 9/2006 | Ashbaugh | 473/448 |

* cited by examiner

*Primary Examiner* — Mitra Aryanpour
(74) *Attorney, Agent, or Firm* — Gulf Coast Intellectual Property Group

(57) ABSTRACT

A basketball training device that simulates the presence of a defensive player more specifically the hand of a defensive player so as to provide practice shooting a basketball with at least a partially restricted view of the basketball goal. The basketball training device further includes a support pad that is releasably secured proximate the lower torso region of the user utilizing an adjustable strap. Movably connected to the support pad is a first support member and a second support member. The second support member is hingedly attached to the first support member. The basketball training device further includes a visual inhibitor movably attached to the second support member opposite the first support member. Operably coupled to the second support member distal to the first support member is an activation cord. The activation cord is further connected at the opposing end to at least one finger of the user's dominant shooting hand. The activation cord will transition the second support member from a first position to a second position thus placing the visual inhibitor proximate the facial region of the user.

8 Claims, 2 Drawing Sheets

BASKETBALL TRAINING DEVICE

PRIORITY UNDER 35 U.S.C Section 119(e) & 37 C.F.R. Section 1.78

This nonprovisional application claims priority based upon the following prior U.S. Provisional Patent Application entitled: Jump Shot Perfector, Application No. 61/217,074, filed May 28, 2009, in the name of James E. Terrell and David Jimenez, which is hereby incorporated by reference for all purposes.

FIELD OF THE INVENTION

The present invention relates to a basketball training device, more specifically but not by way of limitation, a basketball training device that provides training to a user for shooting a basketball while learning to manage a defensive player obstacle such as but not limited to a hand during the shooting process without the requirement of a second individual so as to simulate an environment that will be encountered by the player during a basketball game.

BACKGROUND

Millions of individuals engage and routinely participate in recreational sport of many varieties. Participants of the sports typically will engage in various practice routines so as to increase their ability and to manage certain situations or techniques that may be required during the playing of the game. One such sport that millions routinely engage in is basketball.

Basketball requires a variety of skills that must be developed through hours of practice such as but not limited to, dribbling, passing and shooting. Participants of basketball will routinely practice the aforementioned skills in order to improve their performance and increase their contribution to the team on which they play. One problem with many of these drills is that the requirement of more than one player in order to execute the drill. For example, in order to increase a player's ability to pass, most effective drills require a minimum of two people to properly execute the drill so as to increase the performance of the athlete.

Shooting in another important skill in the game of basketball. Athletes must not only perfect their style of shooting such as but not limited to jump shots or free throw shooting, they must also learn to manage and execute their shot in the presence of defenders. One common practice drill for players to learn to execute their shooting in the presence of defenders is to utilize at least two players wherein on player will engage in offense and practice their shooting while the other player engages in defense and attempts to create game-like scenarios so as to provide the offensive player with the opportunity to practice and execute their shooting style with the presence of the defender. One problem with these conventional drills is the requirement for more than one player. The simulation and practice of learning to shoot a basketball in the presence of the defender utilizing two or more people limits the offensive practice time for at least one of the individuals engaged. Additionally, many athletes that work diligently on the sport of basketball may practice at time or for durations wherein other individuals are not available. Further, as is known to those skilled in the art, the ability to practice and perfect a player's shooting ability while in the presence of defenders leads to significantly increased results during a game situation.

Accordingly, there is a need for a device that can simulate a defender so as to provide a training atmosphere for a single player in order to develop and improve their ability to shoot a basketball in a game situation.

SUMMARY OF THE INVENTION

It is the object of the present invention to provide a basketball training device that simulates the presence of a portion of a defensive player adjacent to the user.

A further object of the present invention is to provide a basketball training device that simulates the presence of a portion of a defensive player that can be releasably secured to the athlete engaged in the training.

An additional object of the present invention is to provide a basketball training device that simulates the presence of the defender, more specifically but not by way of limitation that places an artificial hand proximate the user's facial area.

Yet a further object of the present invention is to provide a basketball training device that utilizes a cord operably coupled to the user's dominant shooting hand in order to move the training device from a first position to a second position wherein in the second position the artificial hand of the training device is proximate the facial region of the user.

Still another object of the present invention is to provide a basketball training device that includes a first member and a second member that are hingedly coupled and wherein the artificial hand is operably coupled to the second member.

A further object of the present invention is to provide a basketball training device that is lightweight and inexpensive.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
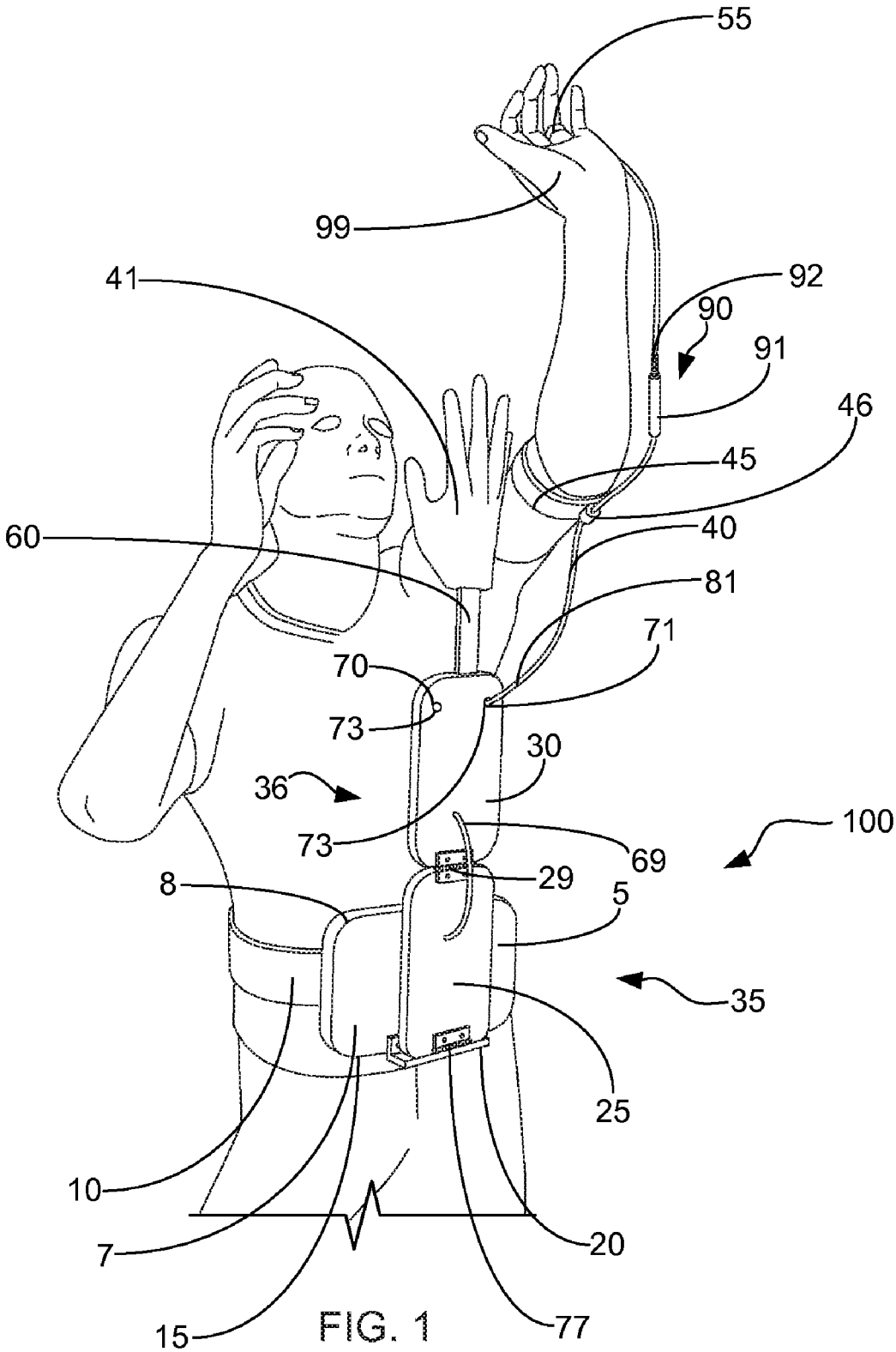
FIG. 1 is a perspective view of the embodiment of the present invention engaged on an individual.
Figure 2:
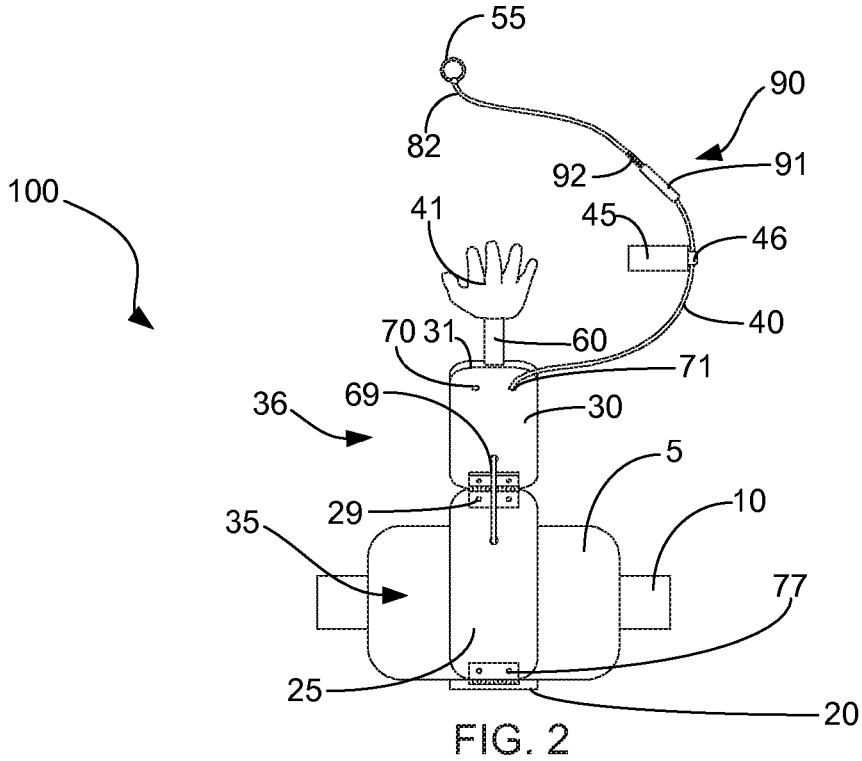
FIG. 2 is a front view of the embodiment of the present invention.
Figure 3:
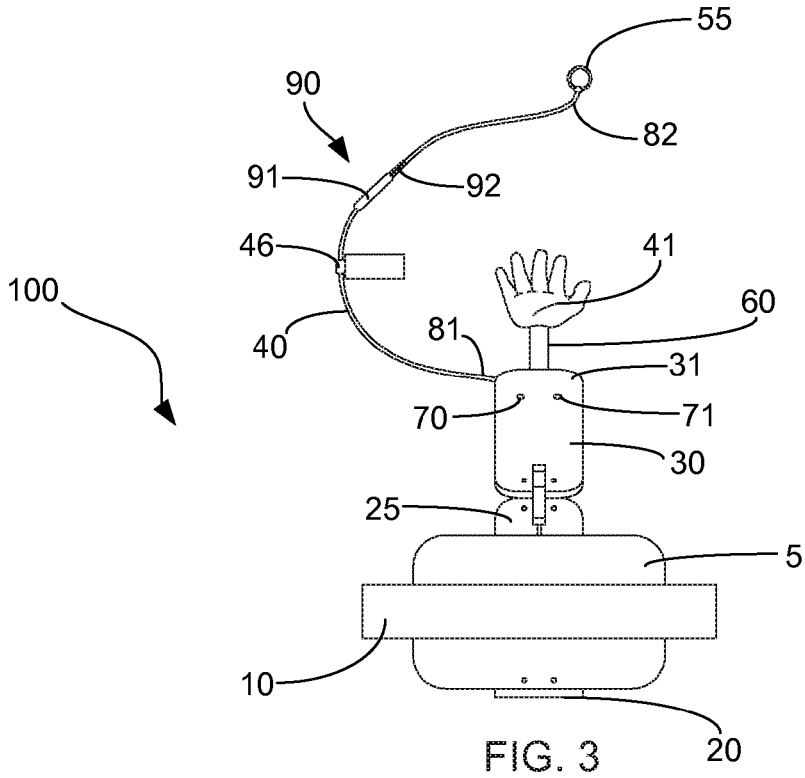
FIG. 3 is rear view of the embodiment of the present invention.

Now referring to the drawings submitted herewith, wherein the various elements depicted therein are not necessarily drawn to scale and wherein like reference numerals are used for like elements throughout the figures and in particular in FIGS. 1 through 3 there is a basketball training device 100 constructed according to the principles of the present invention.

Referring in particular to FIG. 1 is a basketball training device 100 that further includes a support pad 5 having a strap 10 operably coupled thereto. Proximate the bottom edge 15 and secured thereto is a bracket 20, the bracket 20 is hingedly connected to the first support member 25. The first support member 25 is hingedly connected to the second support member 30 which is of similar size and shape as the first support member 25. Operably coupled to the second support member 30 is visual inhibitor 41. The visual inhibitor 41 functions to limit the vision of the user engaged with the basketball training device 100 so as to simulate a defender's hand being proximate the facial region of the user. A cord 40 is secured to one end 31 of the second support member 30. The cord 40 is operably connected to the user via the armband 45 and the loop 55 and functions to move the second support member 30 to a substantially vertical position as the user transitions their hand to shoot a basketball wherein the visual inhibitor acts so as to simulate the presence of a hand of a defensive player.

The support pad 5 is manufactured having a cushioned layer 8 that is manufactured from a suitable durable material such as foam or gel. The cushioned layer 8 functions to provide an engagement surface for the user wearing the basketball training device 100 that conforms to and is comfortable when releasably securing the basketball training device 100 proximate the lower torso region of the user. The support pad 5 further includes a rigid layer 7 that functions to provide a suitable surface for securing the strap 10. The rigid layer 7 is manufactured from a suitable durable material such as but not limited to plastic or metal. The support pad 5 is generally square in shape and is manufactured of suitable size so as to be secured proximate the lower torso region of a user. Those skilled in the art will recognize that the support pad 5 could be manufactured in numerous different sizes and shapes and still achieve the desired function as described herein. The support pad 5 is secured proximate the lower torso region of the user with the strap 10. The strap 10 is secured to the rigid layer 7 utilizing conventional methods such as but not limited to mechanical fasteners and/or chemical adhesion. The strap 10 functions to circumferentially engage the user in order to releasably secure the basketball training device 100 to the user. It is contemplated within the scope of the present invention that the strap 10 could be secured to the user utilizing conventional methods such as but limited to a buckle, hook and loop fastener or other similar device and is manufactured so as to be adjustable in order to accommodate user of different sizes.

A bracket 20 is secured proximate the bottom edge 15 of the support pad 5. The bracket 20 is secured to the rigid layer 7 utilizes conventional suitable durable methods such as but not limited to mechanical fasteners and/or chemical adhesion. The bracket 20 function to provide support for and operable connection to the first support member 25. The first support member 25 is hingedly connected to the bracket 20 utilizing a conventional hinge 77. The first support member 25 is generally planar in manner and rectangular in shape being constructed of a suitable durable material such as but not limited to plastic. The first support member 25 functions to pivot the training assembly 35 either towards or away from the user depending upon the position of the user's hand that is engaged with the cord 40. The range of pivot of the first support member 25 is limited to by a connection member (not illustrated herein) which functions to maintain the first support member 25 in a generally vertical position while the basketball training device 100 is operably coupled to the user. It is contemplated within the scope of the present invention that the first support member 25 could be manufactured in numerous different sizes and shapes.

It is further contemplated within the scope of the present invention that the first support member 25 is additionally slidably attached to the support pad 5 so as to facilitate the movement of the first support member 25 in either a leftwards or rightwards direction along the bottom edge 15 of the support pad 5. The additional slidable connection would facilitate the desired lateral placement for the visual inhibitor 41 in order to adapt to either a left handed user or a right handed user thereby ensuring the desired position of the visual inhibitor 41 proximate the facial region of the user. Those skilled in the art will recognize that numerous suitable mechanical methods could be utilized for slidably attaching the first support member 25 to the support pad 5 in order to achieve the desired objective described herein.

Hingedly attached to the first support member 25 via the second hinge 29 is the second support member 30. The second support member 30 is generally planar in manner and rectangular in shape being of similar size as the first support member 25. The second support member 30 is manufactured of a suitable durable material such as but not limited to plastic. The second support member 30 is pivotally transitioned with the second hinge 29 from a first position to a second position so as to move the upper portion 36 of the training assembly 35 during use of the basketball training device 100. The range of motion between the first position of the second support member 30 to the second position of the second support member 30 is approximately one hundred and eighty degrees. The second support member 30 is generally adjacent to the first support member 25 when a user is in a basketball position other than a shooting position. As the user transitions into a shooting position wherein the user begins to raise their shooting hand such that the user's dominant shooting hand is at least the height of the shoulder region of the user, the second support member 30 pivots the upper portion 36 of the training assembly 35 wherein the visual inhibitor 41 is moved proximate the facial region of the user. The second support member 30 will reach its second position wherein the second support member 30 is in general vertical alignment with the first support member 25. A limiter 69 is operably coupled to the first support member 25 and the second support member 30. The limiter 69 is secured to the first support member 25 and the second support member 30 utilizing conventional suitable durable methods such as but not limited to mechanical fasteners and/or chemical adhesion. The limiter 69 is constructed of suitable durable material such as but not limited to an elastic band. The limiter 31 functions to substantially inhibit the second support member 30 from exceeding a second position that is greater than one hundred and eighty degrees with respect to the first support member 25.

Secured to the second support member 30 is the visual inhibitor 41. The visual inhibitor 41 functions to at least partially inhibit the view of an object such as but not limited to a basketball goal when the user places themselves in position preparing to shoot the basketball. The visual inhibitor 41 is manufactured to be of similar size and shape as a human hand. It is contemplated within the scope of the present invention that the visual inhibitor 41 could be manufactured in numerous different sizes. Furthermore, it is contemplated within the scope of the present invention that the visual inhibitor 41 could be manufactured in other alternate shapes and still achieved the desired function as described herein as to at least partially limit the vision of the user when the user is in a shooting position. The visual inhibitor 41 is operably connected to the second support member 30 utilizing an arm 60. The arm 60 is a conventional telescoping type structure that allows the visual inhibitor 41 to be moved in an upwards-downward direction with respect to the second support member 30. The conventional telescoping structure of the arm 60 allows the visual inhibitor 41 to be adjusted such that the visual inhibitor 41 is proximate the facial region of the user when the user is in the shooting position such that the user has at least their dominant shooting hand at a height either equivalent to or greater than the shoulder region of the user.

A first aperture 70 and a second aperture 71 are journaled through the second support member 30 on opposing sides of the arm 60. The first aperture 70 and second aperture 71 functions to mateably receive a keeper (not illustrated herein)

secured to the first end 81 of the cord 40. The first aperture 70 and the second aperture 71 allow the basketball training device 100 to be configured for either a left-handed user or a right handed user by alternating the position the cord 40 in the appropriate aperture 73. The keeper functions to releasably secure the cord 40 to either the first aperture 70 or the second aperture 71. Those skilled in the art will recognize that numerous conventional fasteners could be utilized to construct the keeper in order to perform the desired function as described herein.

The cord 40 is operably coupled to the second support member 30 and the user's dominant shooting hand 99 and functions to transition the upper portion 36 of the training assembly 35 from its first position to it second position. The cord 40 is constructed of a suitable durable material such as but not limited to nylon. The cord 40 extends to and is slidably connected with the armband 45. The cord 40 is journaled through the tube 46 of the armband 45. The armband 45 is a manufactured from a suitable durable material such as but not limited to nylon and utilizes conventional hook and loop fasteners to be circumferentially secured to the arm of a user. The tube 46 is a conventional style tube that is sufficient in size that allows the cord 40 to move within the tube 46 without binding or any constriction. The tube 46 is integrally secured to the armband utilizing suitable durable methods. The armband 45 and tube 46 function maintain the cord 40 in a position during use of the basketball training device 100 that substantially reduces any interference with the user during normal basketball type activities and functions such as but not limited to dribbling or passing. The cord 40 operably enagages the user's dominant shooting hand 99 with the training assembly 35. The cord 40 is of sufficient length such that when the user assumes the shooting position the cord 40 transitions the second support member 30 from its first position to its second position wherein in its second position the second support member 30 is in a substantially vertical position and the visual inhibitor 41 is proximate the facial region of the user. The cord 40 further includes an adjustment mechanism 90 integrally secured thereto that allows the user to adjust the length of the cord 40 so the visual inhibitor 41 is proximate the facial region of the user when the user is in the shooting position. The adjustment mechanism 90 includes a barrel 91 and rod 92 having mateable threads functioning to allow the user to adjust the length of the cord 40 to the appropriate length to facilitate the transition of the visual inhibitor 41 to the desired position as referenced herein.

A loop 55 is integrated onto the end 82 of the cord 40. The loop 55 functions to engage at least one finger of the user's dominant shooting hand 99. The loop 55 is constructed to be adjustable utilizing suitable conventional methods and can be sized to accommodate a variety of different size finger or a plurality of fingers. The loop 55 serves as the operable connection between the user's dominant shooting hand 99 and the training assembly 35. When the user is in the shooting position, the user's hand is generally at or above the shoulder region of the user. As the user's dominant shooting hand 99 that is engaged with the loop 55 is transitioned to the shooting position the cord 40 moves the second support member 30 from its first position to its second position thereby placing the visual inhibitor 41 proximate the facial region of the user.

Referring in particular to FIG. 1, a description of the operation of the basketball training device 100 is as follows. In use, the user will releasably secure the basketball training device 100 utilizing the strap 10 wherein the strap 10 is circumferentially secured proximate the lower torso region of the user and the support pad 5 is adjacent to the lower torso region of the user. The strap is adjusted to the appropriate tension such that the support pad 5 of the basketball training device 100 is secured in a substantially immobile position. The armband 45 is secured to the dominant arm that the user engages in the shooting position. The cord 40 is journaled through the tube 46 to prevent the cord 40 from interfering with the user as they perform other basketball activities in addition to shooting. The end 81 of the cord 40 is releasably secured to the appropriate aperture 73 depending on whether the user engages their right hand or left hand as the dominant hand in the shooting process. The loop 55 is releasably secured to at least one finger of the user's hand. As the user begins to engage in the practice drill of shooting the basketball wherein the user will raise their dominant shooting hand 99 to at least the level of their shoulder region, the cord 40 will transition the upper portion 36 of the training assembly 35 such that the second support member 30 is substantially in vertical alignment with the first support member 25. Subsequent the training assembly 35 reaching its second position, the visual inhibitor 41 will be proximate the facial region of the user so as to at least partially restrict the view of the user creating the simulation of an environment as to the presence of a defensive player.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A basketball training device comprising:

a training assembly, said training assembly having an upper portion and a lower portion, said training assembly releasably secured proximate a user's waist, said upper portion and said lower portion hingedly connected, said training assembly operably connected to a hand of a user, said training assembly having a first position and a second position, wherein said upper portion hinges with respect to said lower portion approximately one hundred and eighty degrees, said upper portion being configured to provide an operable connection with a cord for either a right-handed or a left-handed player;

a visual inhibitor, said visual inhibitor operably connected to said upper portion of said training assembly, said visual inhibitor operable to at least partially restrict a view of a user when said training assembly is in said second position, wherein said visual inhibitor is proximate a facial region of a user when a user's hand is operably coupled to a cord wherein a user's hand is at least raised to approximately a shoulder level of a user, wherein said visual inhibitor is shaped in the form of a human hand;

a cord, said cord having a first end and a second end, said first end of said cord releasably secured to said upper portion, said second end of said cord releasably secured to at least one finger of a user's hand that is a dominant hand in a shooting process, wherein said cord further includes an adjustment mechanism, said adjustment mechanism operable to alter the length of said cord; and wherein said training assembly is transitioned between said first position and said second position by a user altering a position of a hand that is operably connected to said cord.

2. A basketball training device functioning to simulate a presence of a defending player comprising:

a training assembly, said training assembly including a strap, said strap being circumferentially disposed around a waist of a user functioning to releasably secure said training assembly to a user, said training assembly further including a support pad, said support pad configured to be adjacent a lower torso region of a user, said training assembly further including a first portion and a second portion, said second portion having a first position and a second position, said first portion being movably connected to said support pad, said second portion being hingedly attached to said first portion opposite said support pad, said second portion being in a general vertical alignment with said first portion in said second position, said second portion being configured to provide an operable connection to an activation cord for either a right-handed or a left-handed player, said training assembly further including an activation cord, said activation cord being operably connected to a hand of a user, said activation cord operable to move said second portion from a first position to a second position, said activation cord being operably connected to at least one finger of one hand of a user, wherein the one hand is a dominant hand utilized by a user to shoot a basketball, said second portion being transitioned to said second position subsequent a user moving the one hand operably connected to said activation cord to at least a height that is equivalent to a user's shoulder region a visual inhibitor, said visual inhibitor operably connected to said second portion, said visual inhibitor operable to at least partially block a view of a basketball goal by a user, said visual inhibitor being proximate a facial region of a user when said second portion is in said second position, said visual inhibitor being shaped in the form of a human hand.

3. A basketball training device operable to simulate a presence of a hand of a defensive player wherein the basketball training device is operably connected to a dominant shooting hand of a user comprising:

a support pad, said support pad having a first layer and a second layer, said support pad having a lower end and an upper end, said support pad being generally square in shape, said first layer being substantially rigid, said second layer being constructed of a foam material, said second layer configured to be adjacent a lower torso region of a user and releasably secured thereto;

a first support member, said first support member being generally rigid and substantially planar in manner, said first support member being rectangular in shape, said first support member having a first end and a second end, said first end of said first support member hingedly connected to said lower end of said support pad;

a second support member, said second support member being generally rigid and substantially planar in manner, said second support member being rectangular in shape, said second support member having a first end and a second end, said first end of said second support member hingedly connected to said second end of said first support member, said second support member operable to move between a first position and a second position;

an activation cord, said activation cord operably connected to at least one finger of the dominant shooting hand of a user, said activation cord releasably secured to said second support member proximate said second end, said activation cord operable to transition said second support member between said first position and said second position; and a visual inhibitor, said visual inhibitor movably connected to said second end of said second support member and extending outward therefrom, said visual inhibitor operable to at least partially block a view of a basketball goal by a user when said second support member is in said second position.

4. The basketball training device as recited in claim 3, wherein said visual inhibitor is proximate a facial region of a user when said second portion is in said second position.

5. The basketball training device as recited in claim 4, wherein said second support member is transitioned to said second position subsequent a user moving the dominant shooting hand operably connected to said activation cord to at least a height that is equivalent a user's shoulder region.

6. The basketball training device as recited in claim 5, wherein said second support member includes a first and a second aperture, said first and second aperture being proximate said second end of said second support member, said first and second aperture being configured to provide an operable connections to said activation cord for either a right-handed or a left-handed player.

7. The basketball training device as recited in claim 6, wherein said second support member is in a general vertical alignment with said first support member in said second position.

8. The basketball training device as recited in claim 7, wherein said visual inhibitor is shaped in the form of a human hand.

* * * * *